United States Patent [19]

Clark

[11] 4,029,372

[45] June 14, 1977

[54] GROUNDING ATTACHMENT PLUG AND TERMINAL BLOCK ASSEMBLY FOR CLOTH CUTTING MACHINE

[75] Inventor: Frederick G. Clark, Naples, Fla.

[73] Assignee: Eastman Machine Company, Buffalo, N.Y.

[22] Filed: Aug. 24, 1976

[21] Appl. No.: 717,282

[52] U.S. Cl. ..... 339/14 R; 339/75 P; 339/176 R

[51] Int. Cl.[2] ..... H01R 3/06

[58] Field of Search ..... 339/14 R, 14 P, 75 P, 339/76, 79, 176 R, 176 S, 191 R, 195 R

[56] References Cited

UNITED STATES PATENTS

| | | | |
|---|---|---|---|
| 2,748,362 | 5/1956 | Andis | 339/75 P |
| 2,762,024 | 9/1956 | Heath | 339/14 R |
| 2,861,444 | 11/1958 | Bonanno | 339/176 X |

*Primary Examiner*—Roy Lake
*Assistant Examiner*—DeWalden W. Jones
*Attorney, Agent, or Firm*—Joseph P. Gastel

[57] ABSTRACT

A combined prong shield, grounding construction and locking arrangement for first and second plug sections mounted on a metal motor housing including a grounded metal protective shell surrounding the prongs extending outwardly from the first plug section, prong receiving receptacles in the second plug section, a grounding post on the second plug section for reception in a slot in the protective shell formed between spaced tines, a clamping nut on the post biased toward the tines so as to maintain good grounding contact therewith as the post enters the slot, and upturned ends on the tines for tending to prevent the second plug section from being withdrawn from the first plug section after they have been assembled.

11 Claims, 7 Drawing Figures

Fig. 1.
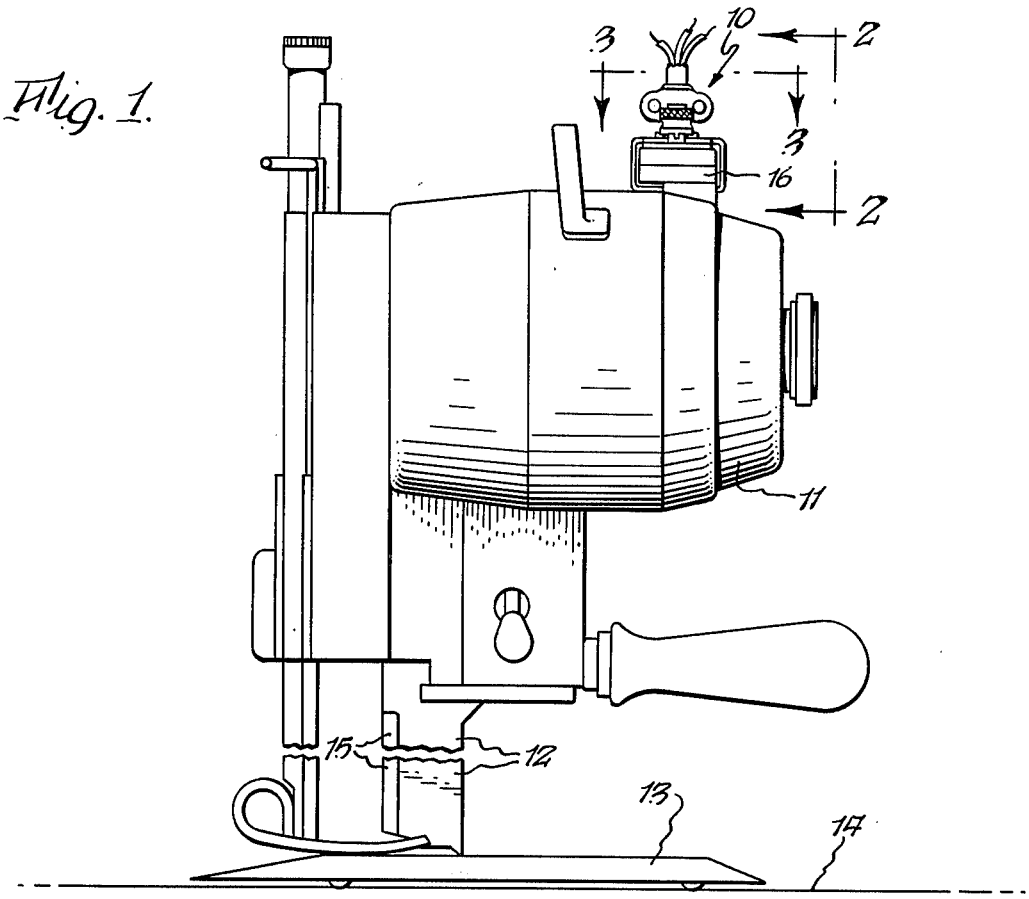
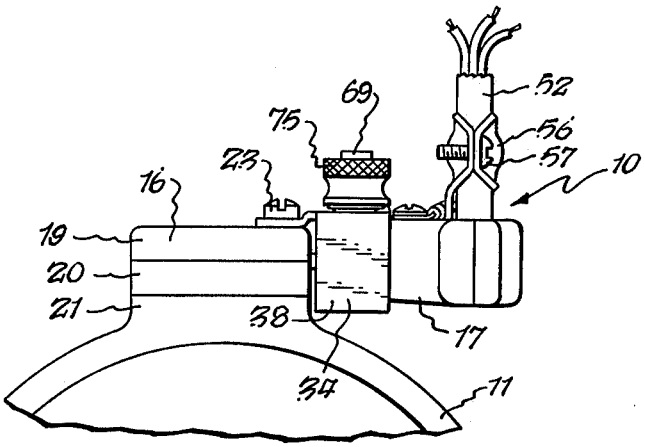
Fig. 2.
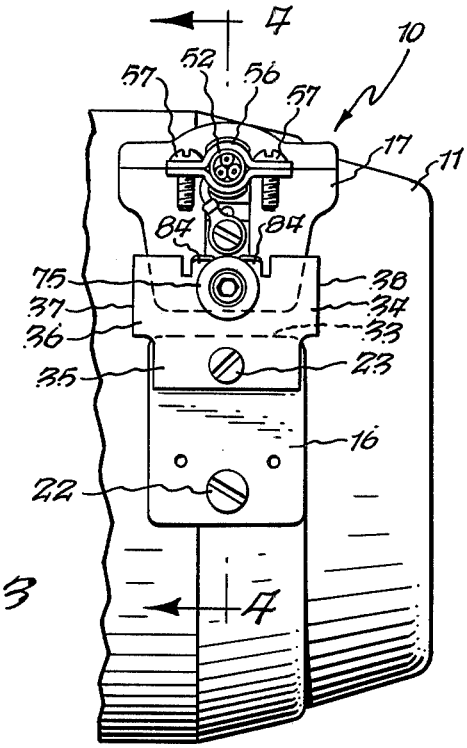
Fig. 3

Fig. 4.
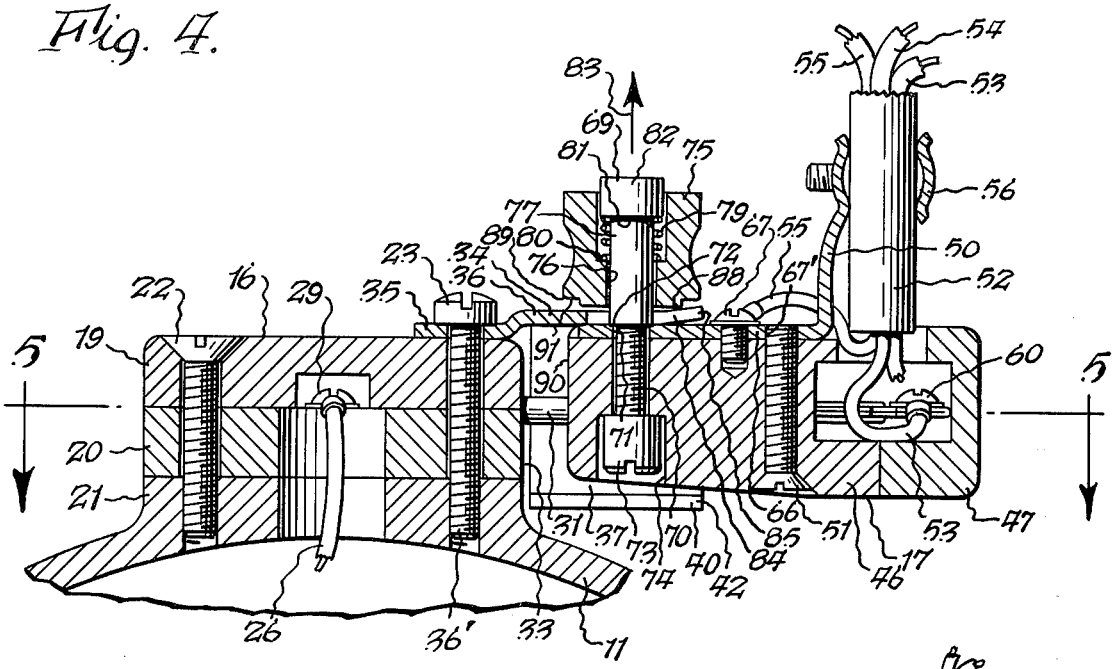
Fig. 6.
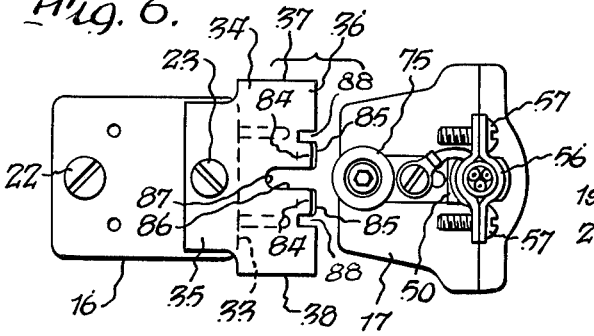
Fig. 7.
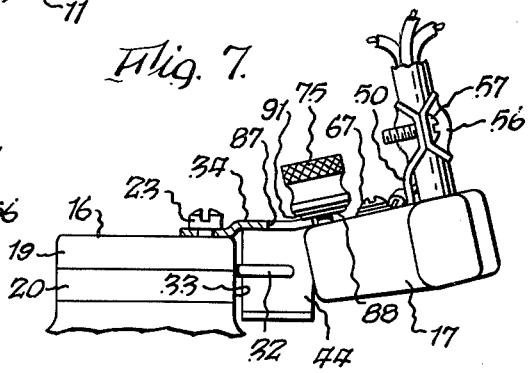
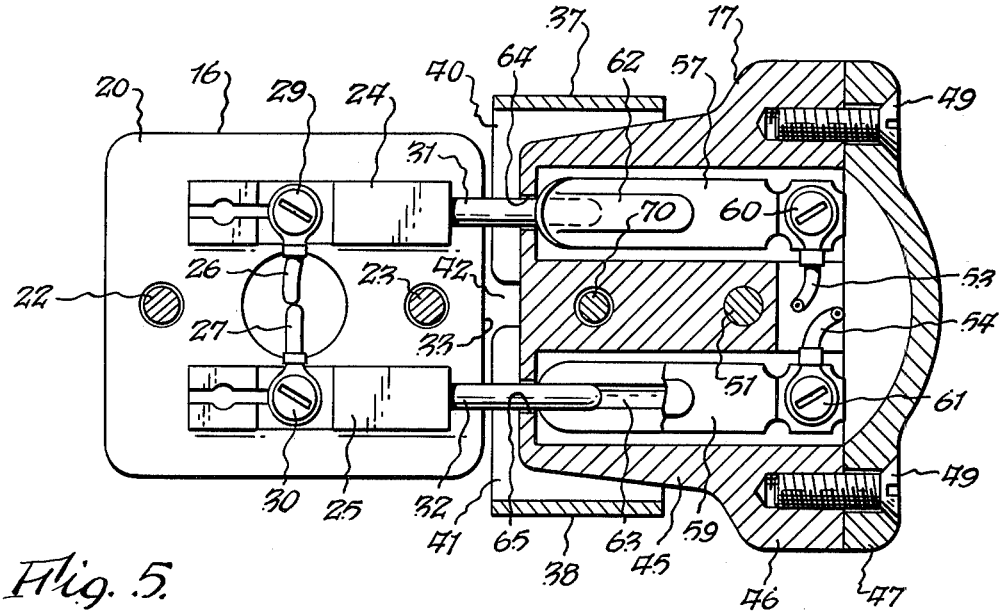
Fig. 5.

GROUNDING ATTACHMENT PLUG AND TERMINAL BLOCK ASSEMBLY FOR CLOTH CUTTING MACHINE

The present invention relates to an improved combined prong shield, grounding construction and locking arrangement for an electrical plug associated with a metal motor housing.

By way of background, electrical codes now require that the electrical plug assembly associated with various types of motor driven machinery, such as cloth cutting machines, include a grounding connection for electrical safety. The grounding connection must contain certain features including structure for making grounding contact before the live electrical leads are engaged. In addition, electrical grounding contact must be maintained at all times. In prior types of similar grounding plugs, the clamping nut associated with a post was manually screwed downwardly thereon for tightening the grounding connection after the live leads were engaged. Thus, the grounding connection was not firmly made until the clamping nut was screwed into position. Therefore, an ungrounded condition could arise while the plug sections were being assembled. In addition, it was quite possible that the person who assembled the plug would not tighten the grounding nut and this could result in a loose grounding connection which would provide only intermittent grounding. Additionally, once the clamping nut was tightened, it was an inconvenience to loosen the nut in order to separate the plug sections. It is with overcoming the foregoing deficiencies of prior art type of grounding plugs that the present invention is concerned.

Accordingly, it is one object of the present invention to provide an improved grounding type of plug in which good grounding engagement is obtained between the plug sections upon their initial engagement and is automatically maintained thereafter until the plug sections are separated.

Another object of the present invention is to provide an improved grounding plug construction which includes a locking arrangement tending to maintain the plug sections in assembled relationsip but which will not prevent the plug sections from being purposely pulled apart. Other objects and attendant advantages of the present invention will readily be perceived hereafter.

The present invention relates to a combined prong shield and grounding construction for an electrical plug for use with a metal motor housing comprising a first plug section having longitudinal prong means extending therefrom, a metal prong shield including a tab, screw means extending through said tab and said first plug section for engagement with said metal motor housing, said prong shield including a protective shell surrounding said longitudinal prong means and spaced therefrom, a second plug section, receptacle means in said second plug section for receiving said longitudinal prong means with a sliding fit, said second plug section having an outer configuration for being received in said protective shell, a grounding connection on said second plug section, a grounding post in electrical contact with said grounding connection, said grounding post extending in a direction substantially perpendicularly to said longitudinal prongs, clamp means mounted on said grounding post, slot means in said protective shell, said slot means being substantially parallel to said longitudinal prong means for receiving said post means when said first and second sections are being assembled, spring means biasing said clamp means toward said second plug section and into engagement with said shell incidental to the entry of said post means into said slot means, whereby grounding is effected automatically upon connecting of said first and second sections. In its more specific aspects, the protective shell includes locking means which tend to maintain the clamp means against separating from the protective shell after the first and second plug sections have been assembled.

The various aspects of the present invention will be more fully understood when the following portions of the specification are read in conjunction with the accompanying drawings wherein:

FIG. 1 is a fragmentary side elevational view of a cloth cutting machine mounting the improved plug construction of the present invention;

FIG. 2 is a fragmentary end elevational view taken in the direction of arrows 2 of FIG. 1;

FIG. 3 is a fragmentary cross sectional view taken substantially along line 3-3 of FIG. 1 and showing the constructional details of various components of the plug assembly;

FIG. 4 is a fragmentary cross sectional view taken substantially along line 4—4 of FIG. 3;

FIG. 5 is a cross sectional view taken substantially along line 5—5 of FIG. 4;

FIG. 6 is a plan view similar to FIG. 3 but showing the first and second plug sections in the position which they occupy immediately prior to being joined and FIG. 7 is a fragmentary side elevational view showing how the plug section carrying the grounding post should be inclined to effect grounding contact before it can be fully inserted into the mating plug section.

The improved plug assembly 10 of the present invention is mounted on the motor housing 11 of a cloth cutting machine. Housing 11 is supported on post 12 which extends upwardly from base 13 which rolls on the surface 14 of a suitable cloth cutting table. As is well known in the art, a reciprocating knife 15 which is driven by a motor within housing 11 effects the desired cloth cutting operation.

The improved plug 10 includes a first plug section 16 which is permanently secured to housing 11, and a second plug section 17 which is selectively placed in mating engagement with first plug section 16. It is necessary to insure that plug section 17, which carries the hot wires, must be grounded before actual electrical contact is made between plug sections 16 and 17. This grounding contact is effected automatically incidental to assembling plug sections 16 and 17 with each other, and further, the grounding mechanism also tends to maintain the first and second plug sections locked to each other against inadvertent separation.

The first plug section 16 includes upper portion 19 and lower portion 20 which are secured to each other and to base 21 on motor housing 11 by means of screws 22 and 23. Conductor bars 24 and 25 are suitably secured between portions 19 and 20. Leads 26 and 27 are connected to conductors 24 and 25 by screws 29 and 30, respectively, and leads 26 and 27 conduct electricity to the electric motor within housing 11. Longitudinal prongs 31 and 32 are formed at the ends of conductor bars 24 and 25, respectively, and extend outwardly beyond end portion 33 of plug section 16.

A metal protective shell 34 includes a tab portion 35 which is secured to plug section 16 by screw 23, the lower end 36 of which is received in the tapped aperture in metal housing 11, whereby shell 34 will be in grounding engagement with housing 11. Shell 34 includes an upper planar portion 36, side portions 37 and 38 formed integrally therewith and lower portions 40 and 41 connected to side portions 37 and 38, respectively. Portions 40 and 41 are separated by slot 42. Protective shell 34 surrounds prongs 31 and 32 so that they cannot be manually engaged when plug section 17 obstructs the opening 44 (FIG. 7) of shell 34.

Plug section 17 includes a housing 45 consisting of portions 46 and 47 which are connected to each other by screws 49 (FIG. 5). A wire clamping member 50 (FIG. 4) is connected to housing portion 46 by means of screw 51. The conductor 52 carrying hot leads 53 and 54 and ground lead 55 is clamped to member 50 by means of clamping attachment 56 which is attached to member 50 by means of screws 57. Leads 53 and 54 are attached to conductor bars 57 and 59 (FIG. 5) by means of screws 60 and 61, respectively. Conductor bars 57 and 59 include female portions 62, and 63, respectively, which receive prongs 31 and 32, respectively, which are inserted into housing portion 46 through apertures 64 and 65, respectively.

Clamping member 50 also functions as a terminal for ground lead 55 which is connected to planar portion or plate 66 of clamping member 50 by means of screw 67. As noted previously, clamping member 50 is attached to housing portion 46 by means of screw 51 which threads into tapped aperture 67 in portion 66.

A grounding post 69 is in good conducting contact with plate 66. In this respect, threaded shank 70 (FIG. 4) of post 69 is received in tapped aperture 71 of plate 66. Post 69 is threaded through aperture 71 until shoulder 72 of post 71 abuts the upper surface of plate 66. To insure that post 69 does not loosen, a nut 73 is threaded onto the end thereof and this nut is received in counterbore 74.

A clamping member or nut 75 has a central aperture 76 which is slidably received on enlarged portion 77 of post 69. A spring 79 is interposed between shoulder 80 on nut 75 and shoulder 81 on the underside of enlarged head 82. Nut 75 can move upwardly in direction of arrow 83 against the bias of spring 79. However, because of the existence of spring 79, clamping nut 75 will always be biased in a direction opposite to arrow 83.

In order to assemble plug sections 16 and 17 with each other, tines 84 (FIG. 6) are received between the underside of clamping nut 75 and the top of plate 66. The fully assembled position is shown in FIG. 4. However, before the fully assembled position can be reached, plug section 17 should be tilted, as shown in FIG. 7, so that the outer ends 85 of tines 84 straddle post 69, as shown in FIG. 7, and the tines 84 force clamping nut 74 upwardly on post 69 against the bias of spring 79. At this time a good grounding connection is made between protective shell 34 and clamping nut 75, but there has not yet been any contact between prongs 31–32 and receptacle apertures 64–65. The grounding contact between clamping nut 75 and protective shell 34 will be maintained until the plug sections 16 and 17 reach their fully assembled position shown in FIG. 4. It is to be noted that annular rim 89 of nut 75 projects outwardly beyond the end 90 of plug section 17. Therefore, the ends 85 of tines 84 can engage the undersurface 91 to exert a prying action pushing nut 83 outwardly in the direction of arrow 83 incidental to assembling plug sections 16 and 17. It is to be especially noted that an annular ridge 88 is formed on the underside of clamping nut 75 to insure good electrical contact with the portions of shell 34 on the opposite sides of slot 86.

It is to be further noted that the upturned ends 85 of tines 84, in addition to insuring good grounding engagement with nut 75 before other electrical connections have been made, as discussed above, also act as a lock or detent to tend to prevent accidental displacement of plug sections 16 and 17. The ends 85 of tines 84 can be turned upwardly in the manner shown in the drawings because of the existence of slots 88 on the opposite sides of tines 84 from slot 86. However, by exerting a proper force tending to pull section 17 away from section 16, the detent holding action can be overcome.

It can thus be seen that the improved attachment plug and terminal block assembly of the present invention is mainifestly capable of establishing good grounding contact between the plug sections upon the initial engagement therebetween and maintaining this grounding contact up to and including the time that the remainder of the electrical connections are made. In addition, the same structure which provides the initial contact also acts as a detent or locking arrangement to tend to prevent inadvertent separation of the plug sections, while permitting them to be purposely separated.

While a preferred embodiment of the present invention has been disclosed, it will be appreciated that it is not limited thereto but may be otherwise embodied within the scope of the following claims.

What is claimed is:

1. A combined prong shield and grounding construction for an electrical plug associated with a metal motor housing comprising a first plug section having longitudinal prong means extending therefrom, a metal prong shield including a tab, screw means extending through said tab and said first plug section and into said metal motor housing, said prong shield including a protective shell surrounding said longitudinal prong means and spaced therefrom, a second plug section, receptacle means in said second plug section for receiving said longitudinal prong means with a sliding fit, said second plug section having an outer configuration for being received in said protective shell, a grounding connection on said second plug section, a grounding post in electrical contact with said grounding connection, said grounding post extending in a direction substantially perpendicularly to said longitudinal prongs, clamp means mounted on said grounding post, slot means in said protective shell, said slot means being substantially parallel to said longitudinal prong means for receiving said post means when said receptacle means are slid over said prong means, spring means biasing said clamp means toward said second plug section and into engagement with said shell incidental to the entry of said post means into said slot means, whereby grounding is effected automatically upon connecting of said first and second plug sections.

2. A construction as set forth in claim 1 including locking means for automatically locking said second plug section in engagement with said first plug section upon completion of the insertion of said prong means into said receptacle means.

3. A construction as set forth in claim 2 wherein said locking means includes grounding means for insuring that a grounding connection is made between said clamp means and said protective shell before said prong means enter said receptacle means.

4. A construction as set forth in claim 3 wherein said locking means and said grounding means comprise tines on opposite sides of said slot means, and upturned outer ends on said tines.

5. A construction as set forth in claim 4 wherein said clamp means comprises a nut, and means slidably mounting said nut on said post means.

6. A construction as set forth in claim 5 including second slots on the sides of said tines which are opposite to the side of said tines adjacent to said slot means for permitting the ends of said tines to be turned upwardly.

7. A construction as set forth in claim 5 wherein said second plug section includes an end portion adjacent said receptacle means, and wherein said nut extends beyond said end portion to permit said tines to effect prying engagement therewith.

8. A construction as set forth in claim 5 including a ridge on the central portion of the underside of said nut facing said protective shell for spacing the outer portion of said underside of said nut from said second section to enhance the sliding of said nut onto said protective shell, said ridge also ensuring good electrical contact between said nut and said shell.

9. A construction as set forth in claim 1 including tines on opposite sides of said slot means, second slot means on opposite sides of said tines from said slot means, and upturned outer ends on said tines.

10. A construction as set forth in claim 9 wherein said clamp means comprises a nut, and ridge means on the central underside portion of said nut facing said shell.

11. A construction as set forth in claim 10 wherein said nut includes a portion which projects outwardly beyond the end of said second section.

* * * * *